US009873999B2

(12) United States Patent
Narotham et al.

(10) Patent No.: US 9,873,999 B2
(45) Date of Patent: Jan. 23, 2018

(54) MATERIAL HANDLING MACHINE

(71) Applicant: JC Bamford Excavators Limited, Uttoxeter, Staffordshire (GB)

(72) Inventors: Harishchandra Narotham, Crewe (GB); James Alexander Hewitt, Uttoxeter (GB)

(73) Assignee: JC Bamford Excavators Limited, Uttoxeter (GB)

( * ) Notice: Subject to any disclaimer, the term of this patent is extended or adjusted under 35 U.S.C. 154(b) by 403 days.

(21) Appl. No.: 14/737,319

(22) Filed: Jun. 11, 2015

(65) Prior Publication Data

US 2015/0361637 A1 Dec. 17, 2015

(30) Foreign Application Priority Data

Jun. 13, 2014 (GB) ..... 1410606.6

(51) Int. Cl.

| | |
|---|---|
| ***E02F 3/43*** | (2006.01) |
| ***E02F 9/20*** | (2006.01) |
| ***E02F 9/22*** | (2006.01) |
| ***E02F 3/32*** | (2006.01) |

(Continued)

(52) U.S. Cl.

CPC ..... *E02F 3/435* (2013.01); *E02F 3/32* (2013.01); *E02F 3/425* (2013.01); *E02F 9/2029* (2013.01);

(Continued)

(58) Field of Classification Search

CPC ... E02F 3/32; E02F 3/425; E02F 3/435; E02F 9/2029; E02F 9/2203; E02F 9/2221;

(Continued)

(56) References Cited

U.S. PATENT DOCUMENTS

| | | | |
|---|---|---|---|
| 5,101,629 | A | 4/1992 | Sugiyama et al. |
| 5,855,159 | A | 1/1999 | Yoshida et al. |

(Continued)

FOREIGN PATENT DOCUMENTS

| | | | |
|---|---|---|---|
| EP | 1662054 | A1 | 5/2006 |
| EP | 1832685 | A1 | 9/2007 |

(Continued)

OTHER PUBLICATIONS

Extended European Search Report for EP 15 16 9229, dated Nov. 26, 2015.

Search Report for GB 1410606.6, dated Dec. 11, 2014.

*Primary Examiner* — Logan Kraft

(74) *Attorney, Agent, or Firm* — Marshall, Gerstein & Borun LLP

(57) ABSTRACT

A material handling machine includes an arm moveable relative to a chassis of the machine, a first hydraulic actuator operable to lift and lower the arm relative to the chassis, a ground engaging implement mounted on the arm and moveable relative to the arm, a second hydraulic actuator operable to move the ground engaging implement relative to the arm, the second hydraulic actuator having a pressured chamber, pressure within the pressure chamber being indicative of a force of engagement between the ground engaging implement and the ground, and a control system. The control system defines a target pressure for the pressure chamber, the control system being arranged such that when a pressure within the pressured chamber exceeds the target pressure the control system operates the first hydraulic actuator to lift the arm to reduce the force of engagement between the ground engaging implement and the ground.

17 Claims, 3 Drawing Sheets

(51) Int. Cl.
*E02F 3/42* (2006.01)
*E02F 9/24* (2006.01)

(52) U.S. Cl.
CPC ..... *E02F 9/2221* (2013.01); *E02F 9/2285* (2013.01); *E02F 9/24* (2013.01); *F15B 2211/31564* (2013.01); *F15B 2211/31588* (2013.01); *F15B 2211/6313* (2013.01); *F15B 2211/665* (2013.01); *F15B 2211/761* (2013.01)

(58) Field of Classification Search
CPC ..... E02F 9/2285; E02F 9/24; F15B 11/044; F15B 2211/30565; F15B 2211/31541; F15B 2211/31564; F15B 2211/31588; F15B 2211/353; F15B 2211/6313; F15B 2211/665; F15B 2211/7053; F15B 2211/761
See application file for complete search history.

(56) References Cited

U.S. PATENT DOCUMENTS

| | | | | |
|---|---|---|---|---|
| 7,490,421 | B1 | 2/2009 | Pletzer et al. | |
| 9,194,107 | B2 * | 11/2015 | Andruch, III ..... | E02F 9/2217 |
| 2010/0146958 | A1 | 6/2010 | Peterson et al. | |
| 2013/0129460 | A1 | 5/2013 | Gabibulayev | |

FOREIGN PATENT DOCUMENTS

| | | | |
|---|---|---|---|
| GB | 2358044 | A | 7/2001 |
| WO | WO-2005/103396 | A1 | 11/2005 |
| WO | WO-2009/035509 | A1 | 3/2009 |
| WO | WO-2013/175699 | A1 | 11/2013 |
| WO | WO-2014/068973 | A1 | 5/2014 |

* cited by examiner

MATERIAL HANDLING MACHINE

FIELD OF THE INVENTION

The present invention relates to a material handling machine.

BACKGROUND OF THE INVENTION

Known material handling machines such as excavators have a material handling arm assembly. The arm assembly may have an arm, known as a boom, pivotally mounted about a generally horizontal axis relative to a chassis of the machine. A further arm, known as a dipper, may be attached to an end of the boom remote from the chassis and may be pivotable about a generally horizontal axis. A material handling implement such as a bucket may be pivotably mounted on an end of the dipper. The boom may be raised and lowered by operation of a first hydraulic ram. The dipper may be moveable relative to the boom by operation of a second hydraulic ram, the bucket may be moveable relative to the dipper by operation of a third hydraulic ram.

In order to handle material, for example dig a trench, a machine operator must simultaneously operate all three hydraulic actuators and this is a skillful process. A skillful operator, when digging a trench, will quickly be able to fill the bucket with material, lift bucket out of the trench and empty the bucket to one or other side of the vehicle. This excavation cycle time or loading cycle time is markedly affected by the initial penetration of the bucket into the ground. If the bucket penetrates too far into the ground then the bucket cannot be drawn through the ground to be filled. Conversely if the bucket does not penetrate far enough into the ground, then the bucket only half fills. Less well trained operators tend to operate at lower excavation/loading cycle times.

Accordingly, there is a need for an improved material handling machine.

SUMMARY OF THE INVENTION

Thus, according to the present invention there is provided a material handling machine including:

an arm moveable relative to a chassis of the machine, a first hydraulic actuator operable to lift and lower the arm relative to the chassis, a ground engaging implement mounted on the arm and moveable relative to the arm, a second hydraulic actuator operable to move the ground engaging implement relative to the arm, the second hydraulic actuator having a pressured chamber, pressure within the pressure chamber being indicative of a force of engagement between the ground engaging implement and the ground, a control system, the control system defining a target pressure for the pressure chamber, the control system being arranged such that when a pressure within the pressured chamber exceeds the target pressure the control system operates the first hydraulic actuator to lift the arm to reduce the force of engagement between the ground engaging implement and the ground.

Advantageously, the system is capable of overriding and/or supplementing an input from the operator when the operator has set the arm height to low so as to automatically lift the arm, which in turn lifts the ground engaging implement thereby allowing the ground engaging implement to move through the ground in the event that the operator has set the arm height too low.

The machine may be arranged such that when a pressure within a pressure chamber is less than the target pressure the control system operates the first hydraulic actuator to lower the arm to increase the force of engagement between the ground engaging implement and the ground.

Advantageously, the control system may override and/or supplement an input from an operator when the operator has set the arm height too high so as to automatically lower the arm thereby preventing only part filling of the ground engaging implement such as a bucket or the like.

BRIEF DESCRIPTION OF THE DRAWINGS

The invention will now be described, by way of example only, with reference to the accompanying drawings in which.

DETAILED DESCRIPTION

Figure 1:
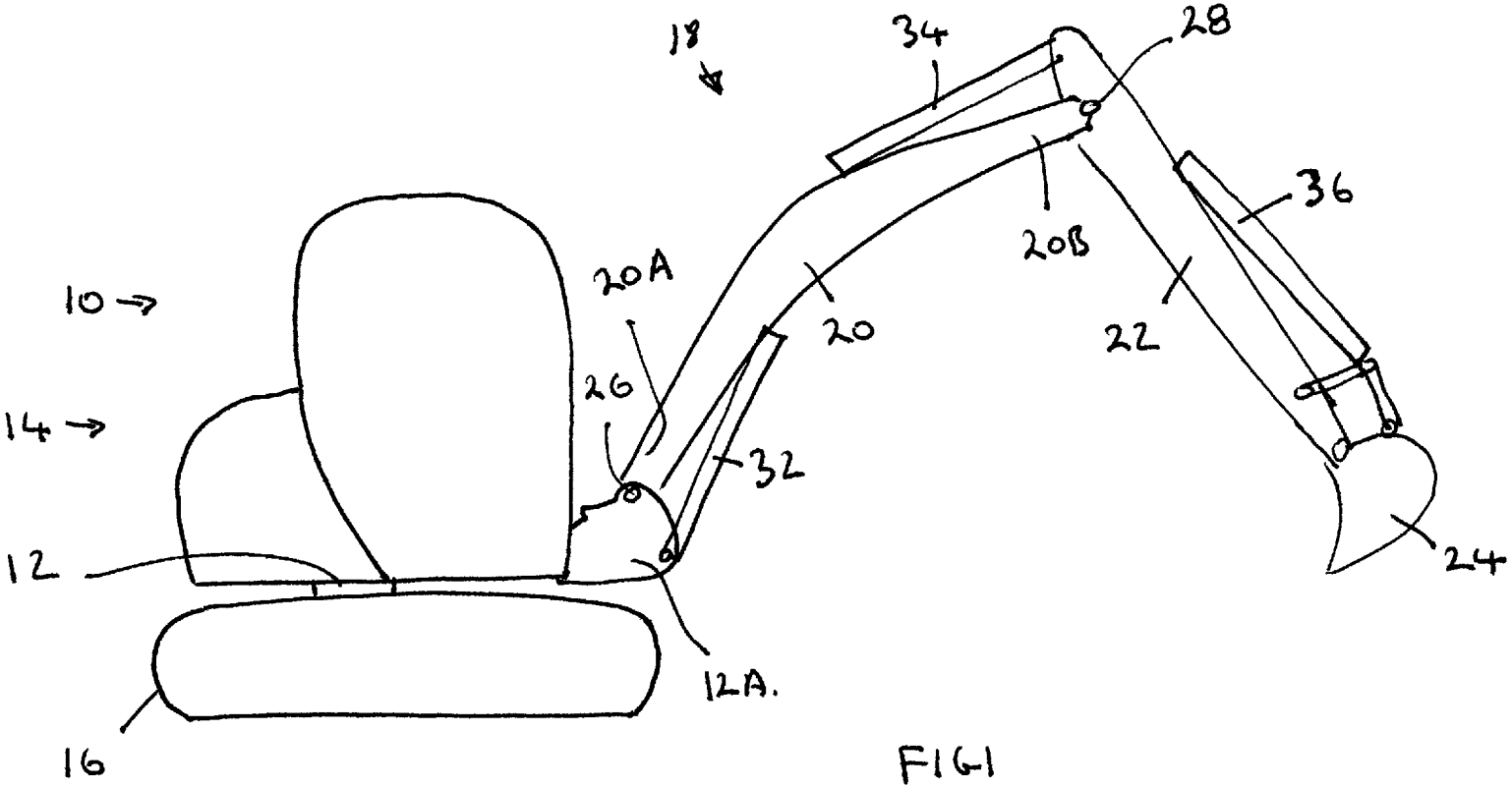
FIG. 1 is a schematic side view of a material handling machine according to the present invention.
Figure 2:
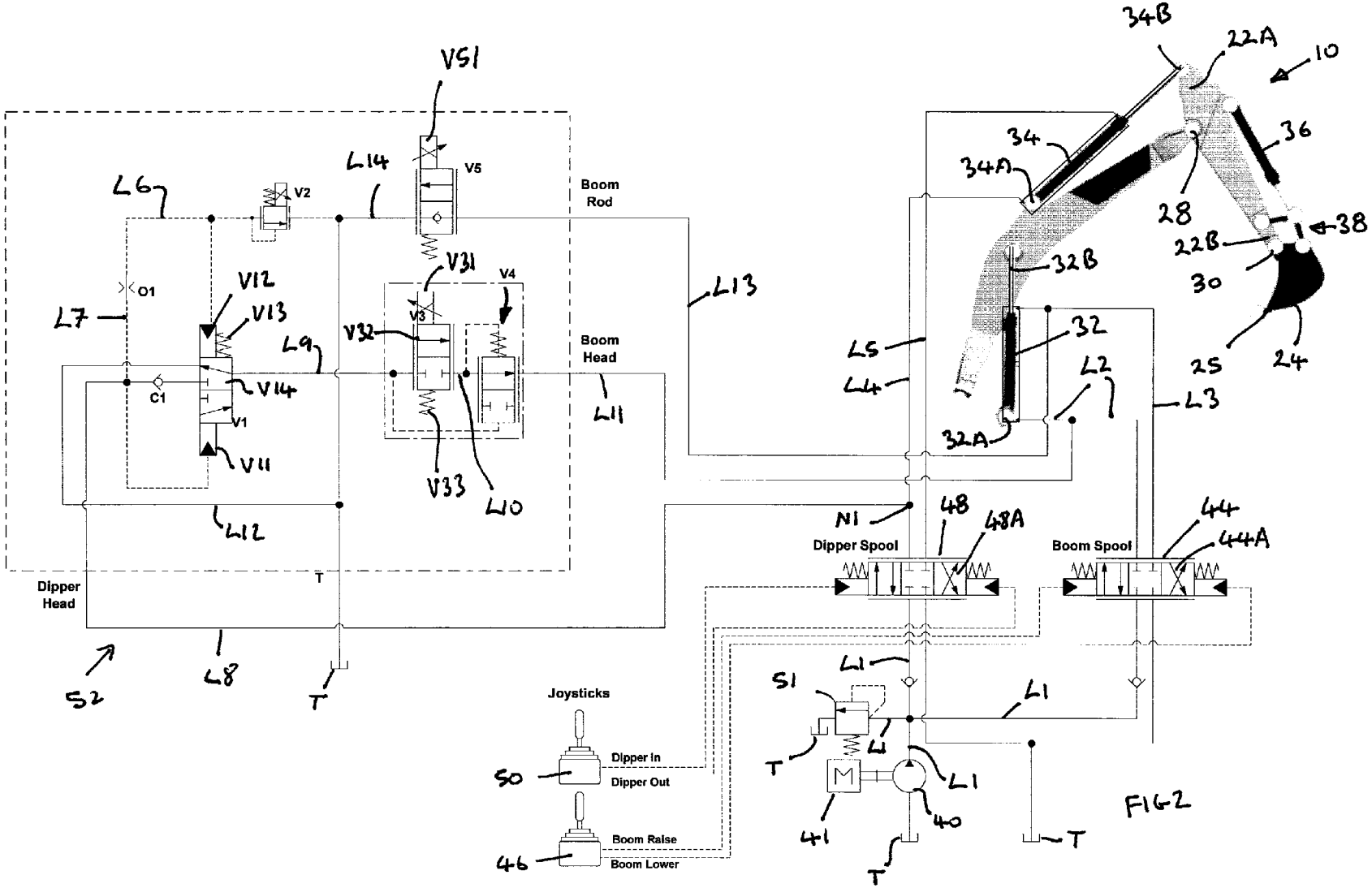
FIG. 2 is a schematic view of part of the material handling machine of FIG. 1.

With reference to FIGS. 1 and 2 there is shown a material handling machine 10 including a chassis 12 and an operator cab 14. The operator cab is mounted on the chassis 12. Ground engaging transport means in the form of a pair of tracks 16 are provided to move the machine over the ground.

Attached to the chassis is an arm assembly 18, the arm assembly includes a first arm in the form of a boom 20, a second arm in the form of a dipper 22 and a ground engaging implement in the form of a bucket 24. The boom 20 is pivotally mounted by pivot 26 to link 12A at a first end 20A of the boom. Link 12A is pivotally mounted at a generally vertical axis relative to the chassis 12. Pivot 26 is orientated horizontally. The dipper is pivotally mounted via pivot 28 to a second end 20B of the boom 20. Pivot 28 is orientated horizontally. The bucket is pivotally mounted via pivot 30 to an end 22B of dipper 22 remote from end 22A of dipper 22. Pivot 30 is orientated horizontally.

A first hydraulic actuator in the form of a first hydraulic ram 32 has a first end 32A pivotally attached to the chassis 12 and a second end 32B pivotally attached to the boom part way between the first and second ends of the boom. A second hydraulic actuator in the form of a second hydraulic ram 34 has a first end 34A pivotally attached to the boom part way between the first and second ends of the boom and a second end 34B pivotally attached to the dipper proximate the first end 22A of the dipper. A third hydraulic actuator in the form of a third hydraulic ram 36 has a first end 36A pivotally attached to the dipper proximate the first end 22A of the dipper and a second end 36B pivotally attached to a linkage mechanism 38 proximate the second end of the dipper. The linkage mechanism 38 per se is known and simply converts extension and retraction movement of the third hydraulic ram 36 into rotary movement of the bucket 24 about pivot 30.

Extension of the first hydraulic ram causes the boom to raise, and contraction of the first hydraulic ram causes lowering of the boom. Extension of the second ram causes the dipper to pivot in a clockwise direction (when viewing FIG. 2) about pivot 28, i.e. causes the boom to move in a "dipper in" direction, and retraction of the second hydraulic ram 34 causes the dipper to move in an anticlockwise direction when viewing FIG. 2 about pivot 28, i.e. in a "dipper out" direction. Extension of the third hydraulic ram 36 causes the bucket 24 to move in a clockwise direction about pivot 30, i.e. in a "crowd" direction, and retraction of the third hydraulic ram 36 causes the bucket to move in an anticlockwise direction about pivot 30, i.e. in a "dump" direction.

The first, second and third hydraulic rams are all double acting hydraulic rams. Double acting hydraulic rams are known per se. They include a piston within a cylinder. The piston is attached to a rod which extends beyond the end of the cylinder. The end of the rod remote from the piston defines one end of the hydraulic ram. The end of the cylinder remote from the rod defines an opposite end of hydraulic ram. A "head side chamber" is defined between the piston and the end of the cylinder remote from the rod. A "rod side chamber" is defined between the piston and the end of the cylinder proximate the end of the rod. Pressurization of the head side pressure chamber extends the ram and pressurization of the rod side chamber causes the ram to retract.

The machine includes a system for operating the first, second and third hydraulic rams, as described below.

A hydraulic pump 40 driven by a prime mover 41. Prime mover 41 may be an internal combustion engine, though other prime movers are suitable. A boom spool valve 44 can be operated by an operator manipulating boom control 46. In this case boom control 46 is a joystick. A dipper spool 48 valve can be controlled via a dipper control 50. In this case dipper control 50 is a joystick. Joystick 50 may be a separate joystick to joystick 46 (as shown in FIG. 2). Alternatively, the boom control 46 and dipper control 50 may be commonized within a single joystick.

The material handling machine also includes a control system 52, the major components of which are valves V1, V2, V3, V4, V5, orifice O1, check valve C1 and associated hydraulic lines as will be further described below.

Valve V1 is a hydraulically operated two position spool valve.

Valve V2 is a hydraulic relief valve wherein the relief valve setting can be varied.

Valve V3 is a two piston solenoid operated hydraulic spool valve.

Valve V4 is a hydraulic compensator valve.

Valve V5 is a two position solenoid operated hydraulic spool valve.

Operation of a material handling machine is as follows:

The control system 52 can be selectively enabled or disabled at the option of the operator. In order to enable the control system 52 the operator actuates a switch, button or other operator input device (not shown) which provides an electrical signal to solenoid V31 of valve V3 to move the spool V32 downwards when viewing FIG. 2 against the bias action of spring V33 thereby opening valve V3. In order to disable the control system 52 the operator actuates the button, switch or other operator input device which deactuates solenoid V31 thereby allowing spring V33 to force spool V32 upward when viewing FIG. 2 into the position as shown in FIG. 2.

Thus, as shown in FIG. 2 the control system 52 is disabled, since valve V3 is closed. Operation of machine with the control system 52 disabled, as shown in FIG. 2, is as follows:

The prime mover 41 drives the hydraulic pump 40 which takes hydraulic fluid from tank T and pressurizes hydraulic line L1. As shown in FIG. 2 the dipper spool valve is closed and the boom spool valve is closed and hence pressurized fluid in line L1 will pass through the relief valve 51 back to tank T.

If it is desired to raise the boom the boom control 46 is operated such that the boom spool 44A of the boom spool valve 44 is moved so as to connect hydraulic line L1 and L2. This causes hydraulic fluid to pass into the head side pressure chamber of the first hydraulic ram thereby extending the hydraulic ram and raising the boom. Hydraulic fluid from the rod side chamber passes into hydraulic line L3 and back to tank T via the boom spool valve 44. In order to lower the boom the boom control 46 is operated to move the boom spool 44A in the opposite direction thereby connecting hydraulic line L1 with L3 and hydraulic line L2 with tank T.

In order to move the dipper in a "dipper in" direction the dipper control 50 is operated such that the dipper spool 48A of the dipper spool valve 48 connects line L1 with hydraulic line L4. Hydraulic line L4 is connected to the head side of the hydraulic ram 34 which causes the ram to extend thereby pivoting the dipper arm in a clockwise direction about pivot 28. Hydraulic fluid in the rod side of hydraulic ram 34 passes into line L5 and then on through the dipper spool valve 48 to tank T. In order to move the dipper in a "dipper out" direction the dipper control 50 is operated such that the dipper spool connects line L1 with L5 and connects line L4 to tank. This results in retraction of the hydraulic ram 34 thereby causing the dipper to move in an anticlockwise direction about pivot 28.

A bucket spool (not shown) and bucket control (not shown) operate in a similar manner to enable crowding or dumping of the bucket.

When digging a trench or the like a typical sequence of movements of the arm assembly is as follows:

Firstly, the boom is lowered and the dipper is moved in a "dipper out" direction thereby moving the bucket teeth 25 of the bucket 24 away from the chassis 12. The boom is then further lowered such that the bucket teeth 25 engage the ground. The bucket is then crowded slightly so as to start to move the bucket teeth through the ground. The dipper control 50, boom control 46 and bucket control (not shown) are then simultaneously operated to progressively move the dipper in "dipper in" direction and to move the boom in a "boom raised" direction and to move the bucket in a "crowd" direction such that the bucket teeth move generally towards the chassis. As will be appreciated, skill is involved in simultaneously manipulating the dipper control 50 and the boom control 46 and the bucket control (not shown) to efficiently fill the bucket with ground material. Once the bucket is full, the boom is raised, the arm assembly is swung laterally relative to the machine and the ground material is then dumped by moving the bucket to a dumped position. The sequence is then repeated. In particular, when filling the bucket if the operator raises the boom too quickly, the bucket will only be partially filled with ground material. Alternatively, if the operator does not raise the boom quickly enough, then the arm assembly will stall because the machine is not powerful enough to drive the bucket through the ground. Indeed under these circumstances rather than the bucket moving through the ground towards the chassis, it may be that the bucket remains stationary and the chassis and cab move towards the bucket. This is clearly undesirable and inefficient in terms of cycle times.

When operated properly, as the bucket teeth cut through the ground a reaction force is provided by the hydraulic fluid in the head side chamber of the hydraulic ram 34. The hydraulic pressure in this chamber is indicative of a force of engagement between the bucket teeth 25 and the ground. Thus, a high pressure in the head side pressure chamber of hydraulic ram 34 indicates a high ground to tooth loading, and conversely a low pressure in the head side pressure chamber of hydraulic ram 34 indicates a low ground to tooth force.

The applicant is the first to recognize that a pressure in a hydraulic cylinder which is indicative of a force of engagement between the ground engaging implement such as a bucket and the ground can be used to control a further hydraulic ram or the like which in turn is operable to alter the force of engagement between the ground engaging implement and the ground.

Operation of the Control System 52

In summary, the control system 52 sets a target pressure for the pressure in the head side chamber of the hydraulic ram 34. If the target pressure is exceeded, then this is indicative of too great a force of engagement between the teeth 25 and the ground and the control system therefore lifts the boom thereby reducing the force of engagement between the teeth and the ground. Conversely if the pressure in the head side chamber of hydraulic ram 34 is below the target pressure then this is indicative of too small a force of engagement between the teeth and the ground and the control system causes the boom to be lowered, thereby increasing the force of engagement between the teeth and the ground. In this manner the control system controls the force of engagement between the teeth and the ground thereby ensuring efficient filling of the bucket and hence improving cycle times.

In more detail:

When the operator desires to use the control system 52, the operator sets the relief valve V2 to a desired relief valve blow off pressure setting (dependent upon the type of ground to be dug) and the button switch or other operator input device mentioned above is actuated thereby powering solenoid V31 and hence opening valve V3 as described above. The system is arranged such that as solenoid V31 is actuated, then simultaneously solenoid V51 is actuated thereby opening valve V5.

In order to start to dig a trench or the like the operator then manipulates the arm assembly 18 so that the teeth 25 are positioned remotely from the chassis and then engages the teeth 25 with the ground by further lowering the boom (as described above). The operator then manipulates the boom control 46, dipper control 50 and bucket control (not shown) so as to draw the teeth 25 generally towards the machine (as described above). Under these circumstances the teeth will be engaged with the ground and the dipper will be moving in a "dipper in" direction by a virtue of the fact that hydraulic ram 34 is being extended.

In the event that the boom is too low, the force of engagement between the teeth and the ground will increase as the dipper moves in the "dipper in" direction thereby increasing the pressure in the head side chamber of ram 34. This pressure is sensed by valve V2 by the virtue of pressure sensing line L6 and L7 being connected to line L8 which in turn is connected to line L4. Thus, once the pressure in the head side of hydraulic ram 34 exceeds the relief valve pressure setting of valve V2, valve V2 opens thereby causing a relatively small flow of hydraulic fluid through line L8, L7, L6 and V2 and back to tank T. As hydraulic fluid flows through valve V2, orifice O1 creates a pressure drop between lines L7 and L6. In particular, the pressure in L7 will be greater than the pressure in L6. This greater pressure in L7 will act on end V11 of valve V1 and the lowered pressure in line L6 will act on end V12 of valve V1. In particular with sufficient flow through orifice O1 the pressure in line L7 will overcome the combined force created by the pressure in line L6 and spring V13 acting on spool V14 thereby moving the spool V14 of valve V1 upwardly when viewing FIG. 2 so as to connect line L8 with line L9. As mentioned above, since valve V3 is open, then line L9 is connected to line L10. Valve V4 is a compensator valve which provides a controlled flow through the valve. Accordingly, line L10 is then connected to line L11. Line L11 is connected to line L2 and as mentioned above, line L2 is connected to the head side chamber of hydraulic ram 32.

Thus, in summary, once the pressure in the head side chamber of hydraulic ram 34A exceeds the target pressure valve V2 opens thereby allowing some of the hydraulic fluid that was passing from pump 40 along line L1 and through the dipper spool valve 48 into line L4 to be diverted at node N1 into lines L8, L9, L10, L11, L2 and into the head side chamber of hydraulic ram 32 thereby raising the boom and hence starting to move the teeth 25 out of the ground and hence reducing the force of engagement between the teeth 25 and the ground.

As will be appreciated, as the control system lifts the boom the pressure within the head side chamber of hydraulic ram 34 may fall below the target pressure in which case valve V2 will close. This causes flow across orifice O1 to cease thereby equalizing the pressures in lines L6 and L7. Once the pressures in lines L6 and L7 are equalized the spool V14 moves back to the position shown in FIG. 2 by virtue of the force of spring V13. With the spool in the position shown in FIG. 2 the head side chamber of hydraulic ram 32 is connected, via line L2, L11, L10, L9 and spool V1 to tank T via line L12. Continued movement of the dipper in the "dipper in" direction combined with the orientation of the bucket teeth relative to the ground naturally causes lowering of the boom as the teeth will naturally tend to further engage the ground, thereby increasing the force of engagement between the teeth and the ground.

As mentioned above, when solenoid V31 of valve V3 is operated, then the system is arranged to simultaneously operate solenoid V51 of valve V5 thereby opening valve V5. Thus, at all times whilst the control system has been enabled, valve V5 is open and open valve V5 simply connects the rod side chamber of hydraulic ram 32 via line L13 to line L14 and hence to tank T. As such the rod side of the actuator 32 is always in a "float" condition, i.e. there is no restriction on hydraulic fluid entering or exiting the rod side hydraulic chamber.

Check valve C1 is arranged to prevent back flow of hydraulic fluid from the head side chamber of hydraulic ram 32 into the head side chamber of hydraulic ram 34 in the event that the pressure in the head side hydraulic chamber of ram 32 exceeds the pressure in the head side hydraulic chamber of ram 34 when the spool V14 is arranged such that lines L8 and L9 are in fluid communication.

As will be appreciated, the control system 52 augments operation of the boom spool valve 44. In particular the operator has full control of the boom spool valve 44, but hydraulic fluid flowing into or out of the head side/rod side chambers of hydraulic ram 32 is augmented by fluid flow along L11 and L13 under certain circumstances.

Figure 3:
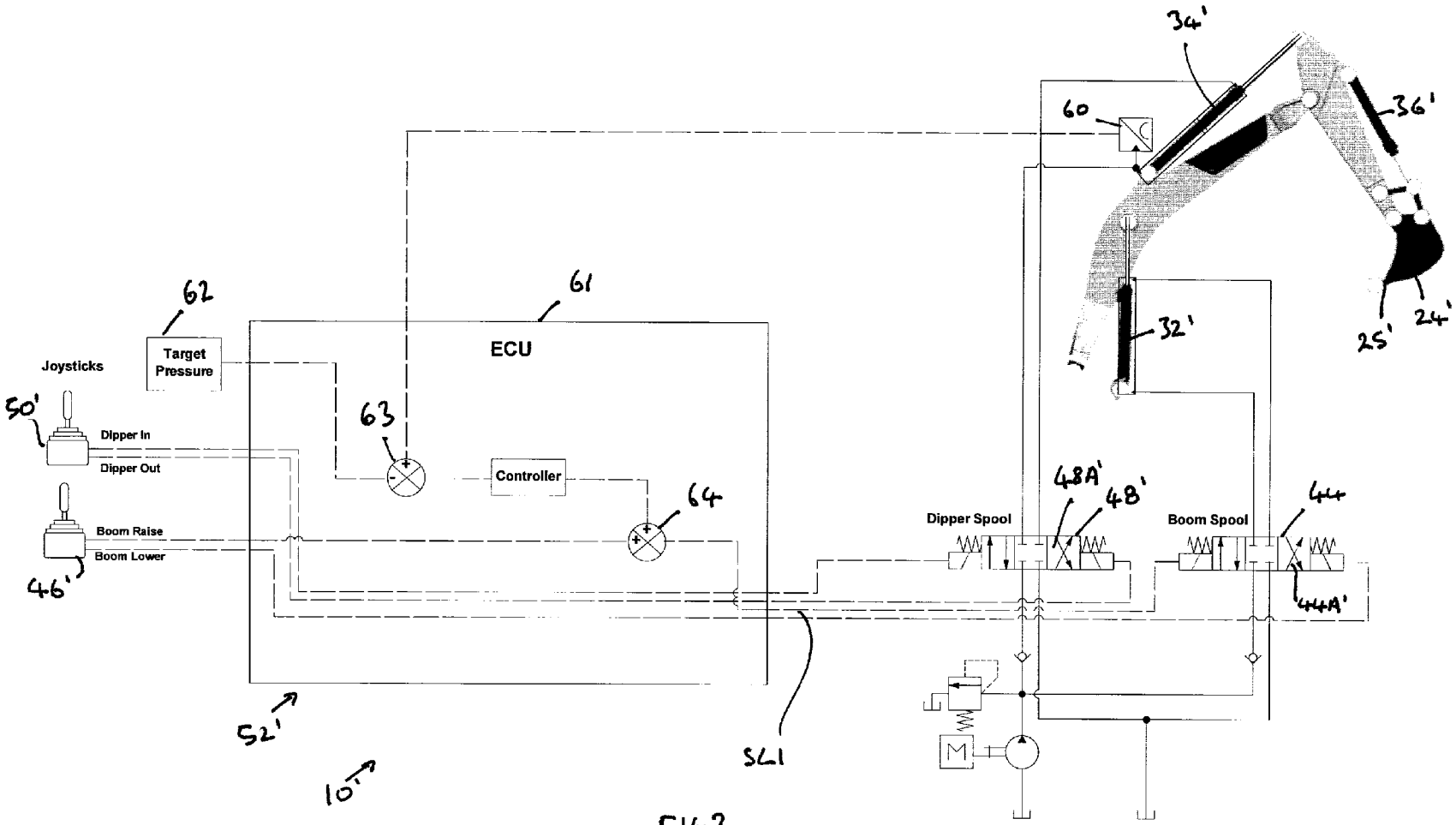
FIG. 3 is a schematic view of an alternative material handling machine.

With reference to FIG. 3 there is shown an alternative material handling machine 10' in which components that fulfill substantially the same function as those of material handling machine 10 are labeled similarly but with the addition of an '. In this case a pressure sensor 60 provides a signal indicative of the pressure within the head side chamber of hydraulic ram 34'. The control system 52' includes a processor, in this case an ECU (electronic control unit). The control system 52' also includes a memory 62 within which can be stored a target pressure. An operator can modify the target pressure stored within the memory 62 dependent upon operating conditions, in particular ground conditions.

The control system 52' can be enabled or disabled by the operator operating a button, switch or other operator input device (not shown).

In this case the dipper spool valve 48' is solenoid operated, as is the boom spool valve 44'.

Operation of the machine 10' with the control system 52' disabled is similar to operation of machine 10 with control system 52 disabled. The only difference being that dipper spool valve 48' and boom spool valve 44' are solenoid operated whereas dipper spool valve 48 and boom spool valve 44 are pressure operated. Clearly, dipper control 50' and boom control 46' are capable of providing an appropriate signal to the solenoids of dipper spool valve 48' and boom spool valve 44'.

When the operator decides to use the control system 52' the operator sets the target pressure stored within memory 62 to desired level (dependent upon type of ground to be dug). The processor receives a signal from sensor 60 indicative of the pressure within the head side chamber of the hydraulic ram 34'. The processor compares this signal with the target pressure using comparator 63. In the event that the signal exceeds the target pressure the processor generates a signal indicative of a need to lift the boom. This signal is combined with a signal from the boom control 46' at a summing device 64 and a composite signal is then fed to the dipper spool valve 48' via signal line SL1. The signal received at the spool valve 48' will move the dipper spool 48A' differently than was instructed by the operator operating the boom control 46' and hence the boom will be raised by hydraulic ram 32'.

In a further embodiment (not shown) the processor can be configured to receive a signal indicative of the pressure in the head side pressure chamber of hydraulic ram 34' and is configured to compare that signal with the target pressure, and in the event that the signal is less than the target pressure the processor is configured to generate a signal indicative of a need to lower the boom, the control system then operating hydraulic ram 32' in response to said signal to lower the boom to increase the force of engagement between the bucket teeth and the ground.

As described above, when digging a trench, the bucket is drawn towards the chassis. Whilst this movement is occurring the boom is raised or lowered, depending upon the force of engagement between the bucket teeth and the ground. As will be appreciated, because the bucket is moving towards the chassis the direction of movement of the bucket teeth is substantially horizontal. However, it may not be exactly horizontal; alternatively it could be angled upwardly as the teeth move towards the chassis or angled downwardly. In other words the direction of movement of the ground engaging implement has a horizontal component of movement. The direction of movement may or may not include a vertical component of movement. Where the direction of movement includes a horizontal component of movement and a vertical component of movement the horizontal component of movement may be greater than the vertical component of movement.

As mentioned above the target pressure may be varied at the discretion of the operator. In particular where the ground is relatively light ground e.g. having a high sand content, then the target pressure may be set relatively low. Alternatively, where the ground is heavy ground e.g. clay, then the target pressure may be set relatively high.

As mentioned above, the control system may be enabled or disabled by operation of a button, switch or other operator input device. However, there are alternative ways of enabling the control system. Furthermore, a control logic controlling enablement or disablement of the control system may require more than one event to enable/disable the system. Thus, the control system may only be enabled when both a button, switch or other operator input device has been operated by the operator and the pressure in the head side pressure chamber of hydraulic ram 34 or 34' is above a medium level. This minimum level may be indicative of the bucket starting to dig the ground. When the pressure is below this minimum level, this may be indicative of the bucket being disengaged from the ground, for example when the boom is being swung to the side so as to dump the material within the bucket. Alternatively, or additionally, the control system may only be enabled when movement of the boom control 46, 46' and/or movement of the dipper control 50, 50' is above a certain level, for example the joystick has been moved passed a certain point.

As described above, pressure in the second hydraulic ram 34 is compared with the target pressure. However, the pressure in the head side hydraulic chamber of the third hydraulic ram 36, 36' is also indicative of forced engagement between the ground engaging implement and the ground, and accordingly valve V2 could be connected to the head side chamber of hydraulic ram 36 or 36' or the pressure sensor 60 could be connected to the head side chamber of hydraulic ram 36 or 36'.

The invention is not restricted to arm assemblies having a boom, dipper and ground engaging implement. The invention is applicable to other arm assemblies. In particular the invention is applicable to the back hoe on a back hoe loading machine.

The invention is also applicable to the loader on a back hoe loading machine. A loader may have an arm pivotally mounted about a horizontal axis relative to the chassis of the back hoe loader. A shovel or other ground engaging implement may be mounted on the arm. In particular the shovel may be directly mounted on the arm, for example pivotally attached to the arm. A first hydraulic ram is operable to lift or lower the arm. A second hydraulic ram is operable to crowd or dump the shovel. The pressure within a pressure chamber of the ram that crowds or dumps the shovel will be indicative of a force of engagement between shovel and the ground, in particular where the machine is being driven forward and the teeth of the bucket are engaged with the ground and the bucket is therefore progressively being filled with ground material. If the force of engagement between the shovel teeth and the ground is too low, then the bucket may be "skimming" across the surface of the ground and not filling. Under these circumstances it is desirable to lower the arm to properly engage the bucket teeth with the ground. Alternatively, if the arm has been lowered too far, then the shovel teeth may be engagement with the ground to such an extent that the machine cannot be driven forward and hence the shovel will not be filled with ground material. Under these circumstances it is desirable to raise the arm thereby lifting the shovel teeth to enable the machine to be driven forward and hence fill the shovel with ground material.

The invention is not restricted to ground engaging implements that collect ground material, such as shovels or buckets. The invention is equally applicable to other ground engaging implements, in particular a blade such as a bulldozer blade.

As described above, the arm assembly 18 is pivotable laterally relative to the cab 14 and chassis 12. In further embodiments this need not be the case. In particular the arm may be mounted directly to the chassis and cab 14 about a generally horizontal axis and the chassis and cab 14 may be able to rotate about a generally vertical axis relative to the ground engaging transport means.

The invention claimed is:

1. A material handling machine including:

an arm moveable relative to a chassis of the machine, a first hydraulic actuator operable to lift and lower the arm relative to the chassis, a ground engaging implement mounted on the arm and moveable relative to the arm, a second hydraulic actuator operable to move the ground engaging implement relative to the arm, the second hydraulic actuator having a pressured chamber, pressure within the pressure chamber being indicative of a force of engagement between the ground engaging implement and the ground, a control system, the control system defining a target pressure for the pressure chamber, the control system being arranged such that when a pressure within the pressured chamber exceeds the target pressure the control system operates the first hydraulic actuator to lift the arm to reduce the force of engagement between the ground engaging implement and the ground.

2. A material handling machine as defined in claim 1 wherein the control system is arranged such that when a pressure within a pressure chamber is less than the target pressure the control system operates the first hydraulic actuator to lower the arm to increase the force of engagement between the ground engaging implement and the ground.

3. A material handling machine as defined in claim 1 wherein the control system can be selectively enabled and/or selectively disabled.

4. A material handling machine as defined in claim 3 wherein the control system is selectively enabled and/or selectively disabled by operation of a hydraulic valve, preferably the hydraulic valve is a spool valve.

5. A material handling machine as defined in claim 1 wherein the target pressure is selectively changeable.

6. A material handling machine as defined in claim 5 wherein the target pressure is defined by a hydraulic pressure relief valve, preferably a variable hydraulic pressure relief valve.

7. A material handling machine as defined in claim 1 wherein the first hydraulic actuator includes a pressure chamber operable to lift the arm relative to the chassis, the control system being arranged such that when a pressure within the pressure chamber of the second hydraulic actuator exceeds the target pressure, some of the hydraulic fluid flow towards the pressure chamber of the second hydraulic actuator is diverted towards the pressure chamber on the first hydraulic actuator to lift the arm.

8. A material handling machine as defined in claim 7 wherein the hydraulic flow diverted towards the pressure chamber of the first hydraulic actuator passes through a one way valve to prevent reverse flow.

9. A material handling machine as defined in claim 7 wherein the hydraulic flow diverted towards the pressure chamber of the first hydraulic actuator passes through a hydraulic valve operable to control hydraulic flow into and out of the pressure chamber of the first hydraulic actuator preferably the hydraulic valve is a spool valve.

10. A material handling machine as defined in claim 1 wherein the control system includes a processor.

11. A material handling machine as defined in claim 10 wherein the target pressure is stored in memory.

12. A material handling machine as defined in claim 10 wherein the processor is configured to receive a signal indicative of a pressure in the pressure chamber and is configured to compare said signal with the target pressure, and in the event that the signal exceeds the target pressure the processor is configured to generate a signal indicative of a need to lift the arm, the control system operating the first hydraulic actuator in response to said signal to lift the arm to reduce the force of engagement between the ground engaging implement and the ground.

13. A material handling machine as defined in claim 12 wherein the processor is configured to receive a signal indicative of a pressure in the pressure chamber and is configured to compare said signal with the target pressure, and in the event that the signal is less than the target pressure the processor is configured to generate a signal indicative of a need to lower the arm, the control system operating the first hydraulic actuator in response to said signal to lower the arm to increase the force of engagement between the ground engaging implement and the ground.

14. A material handling machine as defined in claim 1, wherein the ground engaging implement is pivotally mounted directly on the arm.

15. A material handling machine as defined in claim 1, wherein the second hydraulic actuator has a first end mounted on the arm.

16. A material handling machine as defined in claim 1, wherein the arm is a first arm and the ground engaging implement is mounted on a second arm, the second arm being mounted on the first arm, the second arm being moveable relative to the first arm.

17. A material handling machine as defined in claim 16 wherein the second hydraulic actuator has a first end mounted on the second arm.

* * * * *